US007479299B2

(12) United States Patent
Raybould et al.

(10) Patent No.: US 7,479,299 B2
(45) Date of Patent: Jan. 20, 2009

(54) METHODS OF FORMING HIGH STRENGTH COATINGS

(75) Inventors: Derek Raybould, Denville, NJ (US); Murali N. Madhava, Gilbert, AZ (US)

(73) Assignee: Honeywell International Inc., Morristown, NJ (US)

( * ) Notice: Subject to any disclaimer, the term of this patent is extended or adjusted under 35 U.S.C. 154(b) by 170 days.

(21) Appl. No.: 11/044,873

(22) Filed: Jan. 26, 2005

(65) Prior Publication Data

US 2006/0166020 A1 Jul. 27, 2006

(51) Int. Cl.
*B05D 1/02* (2006.01)

(52) U.S. Cl. ..... 427/191; 427/192; 427/202; 427/205; 427/376.6; 427/376.7

(58) Field of Classification Search ..... None
See application file for complete search history.

(56) References Cited

U.S. PATENT DOCUMENTS

| | | | | |
|---|---|---|---|---|
| 3,499,176 | A * | 3/1970 | Bahnsen | 8/149.1 |
| 4,389,262 | A | 6/1983 | Tanner | |
| 4,582,536 | A | 4/1986 | Raybould | |
| 4,664,176 | A | 5/1987 | Liebermann | |
| 4,769,094 | A | 9/1988 | Park et al. | |
| 4,869,751 | A | 9/1989 | Zedalis et al. | |
| 5,076,865 | A | 12/1991 | Hashimoto et al. | |
| 5,198,042 | A | 3/1993 | Masumoto et al. | |
| 5,302,414 | A | 4/1994 | Alkhimov et al. | |
| 5,634,989 | A | 6/1997 | Hashimoto et al. | |
| 5,765,625 | A | 6/1998 | Yukumoto et al. | |
| 5,842,511 | A | 12/1998 | Raybould et al. | |
| 6,231,697 | B1 * | 5/2001 | Inoue et al. | 148/561 |
| 6,277,212 | B1 | 8/2001 | Ames et al. | |
| 6,296,948 | B1 | 10/2001 | Ames et al. | |
| 6,551,664 | B2 | 4/2003 | Kaufold et al. | |
| 6,592,947 | B1 | 7/2003 | McCane et al. | |
| 6,602,545 | B1 | 8/2003 | Shaikh et al. | |
| 6,715,640 | B2 | 4/2004 | Tapphorn et al. | |
| 6,780,458 | B2 | 8/2004 | Seth et al. | |
| 7,003,864 | B2 * | 2/2006 | Dirscherl | 29/527.2 |
| 2001/0041221 | A1 | 11/2001 | Kaufold et al. | |
| 2002/0182314 | A1 | 12/2002 | Leonardi et al. | |
| 2003/0039858 | A1 | 2/2003 | Gillispie et al. | |
| 2003/0143402 | A1 | 7/2003 | Hon et al. | |
| 2003/0207148 | A1 | 11/2003 | Gillispie et al. | |
| 2003/0209286 | A1 | 11/2003 | Leonardi et al. | |
| 2004/0011245 | A1 | 1/2004 | Sambasivan et al. | |
| 2004/0106015 | A1 | 6/2004 | Damani et al. | |

FOREIGN PATENT DOCUMENTS

WO 02/042056 A1 * 5/2002

OTHER PUBLICATIONS www.reade.com MSDS for Titanium Aluminide, date unknown.*
"Gas Dynamic prinicples of Cold Spraying", R.C. Dykhuizen et al, Journal of Thermal Spraying, 7(2) Jun. 1998, pp. 205-212.*

* cited by examiner

*Primary Examiner*—Frederick J Parker
(74) *Attorney, Agent, or Firm*—Ingrassia Fisher & Lorenz, P.C.

(57) ABSTRACT

The present invention thus provides an improved method for coating turbine engine components. The method utilizes a cold high velocity gas spray technique to coat turbine blades, compressor blades, impellers, blisks, and other turbine engine components. These methods can be used to coat a variety of surfaces thereon, thus improving the overall durability, reliability and performance of the turbine engine itself. The method includes the deposition of powders of alloys of nickel and aluminum wherein the powders are formed so as to have an amorphous microstructure. Layers of the alloys may be deposited and built up by cold high velocity gas spraying. The coated items displayed improved characteristics such as hardness, strength, and corrosion resistance.

17 Claims, 1 Drawing Sheet

METHODS OF FORMING HIGH STRENGTH COATINGS

FIELD OF THE INVENTION

The present invention relates to amorphous and microcrystalline structures and coatings. More particularly the invention relates to deposition of amorphous powdered alloys of nickel and aluminum by cold high velocity spraying techniques and the heat treatment thereof.

BACKGROUND OF THE INVENTION

In a variety of technologies, there is a continuing need for stronger, corrosion-resistant and wear-resistant materials. For example, research into nickel-based alloys has resulted in the development of alloy additions that display minor but important property improvements. It is believed that still further improvement can be obtained by controlling the microstructure of such alloys. Directionally solidified alloys and single crystal alloys are examples of alloy microstructure control that find application in numerous industries, including the aerospace industry.

In the realm of microstructures, the amorphous-type microstructure has not yet been fully exploited. Amorphous metals, also sometimes referred to as glassy metals or liquid metals, are generally formed by extremely rapid quenching of a specific alloy composition from the liquid state. The rapid cooling process solidifies the liquid structure which has no long range periodicity such that an amorphous, rather than crystalline, microstructure appears in the solid. Amorphous ribbon or foil is routinely produced by casting molten metal on a rotating wheel as described in several US patents, examples of the more recent being U.S. Pat. No. 4,664,176, CASTING IN A THERMALLY-INDUCED LOW DENSITY ATMOSPHERE, and U.S. Pat. No. 5,842,511, CASTING WHEEL HAVING EQUIAXED FINE GRAINED QUENCH SURFACE. These materials are sold under the Metglas® name for use as transformer laminations, braze foil, and security strips. Amorphous or microcrystalline material can also be formed by some powder production routes, such as produce very fine usually spherical powders of about 1 to 30 microns depending upon the alloy. It is therefore known how to manufacture metal alloys in ribbon, wire, and particle type shapes where the alloy possesses the amorphous microstructure. These amorphous metals have displayed promising characteristics, including high strength and corrosion resistance.

The use of amorphous materials, particularly aluminum alloys, titanium alloys, and nickel alloys, in practical industrial applications, has nevertheless been limited. One problem encountered in the use of amorphous materials is that the production of larger, consolidated structures from the starting ribbon or powder forms may require the use of elevated temperature processing. However, that exposure of an amorphous material to elevated temperature often results its crystallization and the loss of the amorphous microstructure. U.S. Pat. No. 4,582,536, PRODUCTION OF INCREASED DUCTILITY IN ARTICLES CONSOLIDATED FROM RAPIDLY SOLIDIFIED ALLOYS, describes ways to avoid the loss of the amorphous structure and to exploit the microcrystalline structure, but as with other approaches to date these have several disadvantages and are expensive and difficult to carry out, especially for actual parts rather than test samples.

Even aluminum which is much softer than Ni based alloys can not be consolidated to form a part without loss of the desired amorphous or microcrystalline structure. U.S. Pat. No. 4,869,751, THERMOMECHANICAL PROCESSING OF RAPIDLY SOLIDIFIED HIGH TEMPERATURE Al-BASE ALLOYS, teaches how to retain some of the desired microstructure, but high temperatures, 400 to 500° C., (for aluminum) have to be used, so most of the potential properties are lost.

Hence, there is a need for an improved method to fabricate large, consolidated forms with amorphous metallic materials. The method should avoid the exposure of the amorphous material to high temperatures and should be economical. Additionally, there is a need for a method to control the microstructure of alloys during manufacturing and processing treatments. The present invention addresses one or more of these needs and others not explicitly or implicitly stated herein.

SUMMARY OF THE INVENTION

The present invention provides a method to deposit amorphous metal materials onto a substrate or into a form. The method uses a cold high velocity gas process to spray metallic powders with an amorphous or microcrystalline microstructure. The cold gas method described herein avoids excessively heating the powder such that an amorphous or microcrystalline microstructure is displayed in the materials of the target structure.

In one exemplary embodiment, and by way of example only, there is provided a method for forming an article comprising the steps of: selecting a material from the group consisting of alloys of aluminum, copper, nickel, iron or tungsten; providing a powder of the selected material wherein the powder comprises an amorphous microstructure and wherein the powder substantially has particle size of between about 1 to about 50 microns; accelerating the powder of the selected material in a carrier gas such as air or an inert gas; and directing the powder against a surface so as to form a deposited layer of the powder material by a cold high velocity gas spraying process. Additional steps may include providing a heat treatment for example for Ni alloys at a temperature of approximately 1500° F. on the deposited layer of the powder material so as to cause the formation of a microcrystalline microstructure. Further steps may also include providing a suitable workpiece with a surface and preparing the workpiece for receiving the powder material by cold spray. The thickness of the deposited layer may be measured, and additional layers of material deposited on top of a previously deposited layer, with these steps repeated so as to generate a freestanding structure. The additional layers may be of a different alloy, so that layers or areas of a different composition are formed giving the part improved wear resistance at some locations and a high toughness at others, depending on the loads and service the different locations experience in service.

Other independent features and advantages of the method for developing high strength amorphous and microcrystalline structures and coatings will become apparent from the following detailed description, taken in conjunction with the accompanying drawings which illustrate, by way of example, the principles of the invention.

DETAILED DESCRIPTION OF A PREFERRED EMBODIMENT

Reference will now be made in detail to exemplary embodiments of the invention, examples of which are illustrated in the accompanying drawings. Wherever possible, the same reference numbers will be used throughout the drawings to refer to the same or like parts.

It has now been conceived that a cold high velocity gas spraying process may be used to form structures having an amorphous and/or microcrystalline metallic microstructure. The method uses a cold high velocity gas stream to accelerate and deposit metallic powders with an amorphous, nano-, or microcrystalline microstructure. Powders may be deposited as a coating; additionally powders may be deposited so as to build up a structure with an amorphous or nano-, or microcrystalline microstructure.

The method of developing high strength amorphous structures has already been briefly described. The literature includes patents describing amorphous and rapidly solidified materials and how to produce them. Recent US patents include U.S. Pat. No. 4,769,094, entitled AMORPHOUS NICKEL-BASE ALLOY ELECTRICAL RESISTORS, discloses particular methods for creating amorphous nickel alloys. Also U.S. Pat. No. 5,634,989, entitled AMORPHOUS NICKEL ALLOY HAVING HIGH CORROSION RESISTANCE, teaches methods of manufacturing nickel alloys. Another method for fabricating a metallic particle or powder with amorphous microstructure is disclosed in U.S. Pat. No. 5,198,042. Various other methods for manufacturing ribbons or strips of amorphous metals are also described in the patent literature. Such patents include U.S. Pat. Nos. 6,277,212; 6,296,948; and 5,765,625. Each of the identified patents is incorporated herein by reference.

The amorphous compositions described above demonstrate improved performance with respect to oxidation resistance and corrosion resistance. Turbine blade tips coated with such materials are better able to withstand the corrosive and oxidative forces encountered in a gas turbine engine.

The amorphous composition described herein can be manufactured as a powder for use in depositions using a cold high velocity gas spraying technique. In one embodiment, an alloy including all elemental constituents is first prepared. The alloy material may be put in powderized form by conventional powder processing methods, such as inert gas atomization from ingots. A preferred diameter for the metallic powder particles, regardless how formed, is between about 1 to about 50 microns.

Figure 1:
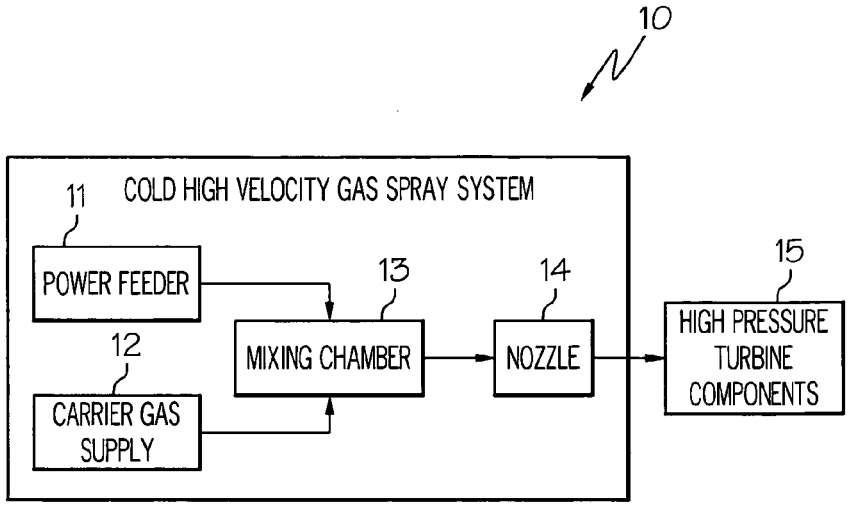
FIG. 1 is a diagrammatic representation of the equipment and apparatus that may be used to perform cold high velocity gas spraying in accordance with an embodiment of the present invention.

In a preferred method, the amorphous composition is deposited through a cold high velocity gas spraying process. Referring now to FIG. 1 there is shown an exemplary spray system 10 illustrated diagrammatically. The system 10 is illustrated as a general scheme, and additional features and components can be implemented into the system 10 as necessary. The main components of the spray system 10 include a powder feeder 11 for providing powder materials, a carrier gas supply 12 (typically including a heater), a mixing chamber 13 and a convergent-divergent nozzle 14. In general, the system 10 mixes the repair particles with a suitable pressurized gas in the mixing chamber 13. The particles are accelerated through the specially designed nozzle 14 and directed toward a target surface on the turbine component 15. When the particles strike the target surface, converted kinetic energy causes plastic deformation of the particles, which in turn causes the particle to form a bond with the target surface. Thus, the high velocity spray system 10 can bond powder materials to a gas turbine engine component surface.

The high velocity spray process may be referred to as a "cold gas" process because the particles are mixed and applied at a temperature that is far below the melting point of the particles. The kinetic energy of the particles on impact with the target surface, rather than particle temperature, causes the particles to plastically deform and bond with the target surface. Therefore, bonding to the component surface takes place as a solid state process with insufficient thermal energy to transition the solid powders to molten droplets. Typically during spraying the coating and part have an average temperature of less than 100° C.

A variety of different systems and implementations can be used to perform the cold high velocity gas spraying process. For example, U.S. Pat. No. 5,302,414, entitled "Gas Dynamic Spraying Method for Applying a Coating" and incorporated herein by reference, describes an apparatus designed to accelerate materials having a particle size diameter of between 5 to about 50 microns (particle size down to 1 micron may be used), and to mix the particles with a process gas to provide the particles with a density of mass flow between about 0.05 and 17 g/s-cm$^2$. Supersonic velocity is imparted to the gas flow, with the jet formed at high density and low temperature using a predetermined profile. The resulting gas and powder mixture is introduced into the supersonic jet to impart sufficient acceleration to ensure a particle velocity ranging between about 300 and 1200 m/s. In this method, the particles are applied and deposited in the solid state, i.e., at a temperature which is considerably lower than the melting point of the powder material. The resulting coating is formed by the impact and kinetic energy of the particles which gets converted to high-speed plastic deformation, causing the particles to bond to the surface. The system typically uses gas pressures of between 5 and 20 atm, and at a temperature of up to 800° F. As non limiting examples, the gases can comprise air, nitrogen, helium and mixtures thereof. Again, this system is but one example of the type of system that can be adapted to cold spray powder materials to the target surface.

The powder materials that may be used in the cold spraying process include alloys of iron, nickel, copper, aluminum, and tungsten, wherein the powders include powders with an amorphous microstructure. It will be appreciated by those skilled in the art that powders intended to be amorphous and created by a process so as to have an amorphous microstructure may nevertheless still include within them particles that have a crystalline structure. Thus, it is stated that the overall powder should at least include powders with an amorphous microstructure. In other embodiments, it may be desired to combine amorphous powders with crystalline powders. Thus, for example when it is desired that a spray coating only include a percentage of material with an amorphous microstructure, the powder feed material may be a blend of powders with an amorphous and crystalline microstructures.

In one preferred embodiment, a powder is provided that includes an alloy of aluminum and silicon materials (preferably amorphous or microcrystalline). The percentage of silicon in the blend may be up to 30% or greater by weight. Another preferred alloy includes combinations of aluminum and iron. Another preferred powder combination includes Al, Fe, V, and Si (AlFeVSi).

Having described the amorphous composition and cold gas dynamic spraying apparatus from a structural standpoint, a method of using such an amorphous composition and apparatus will now be described.

Figure 2:
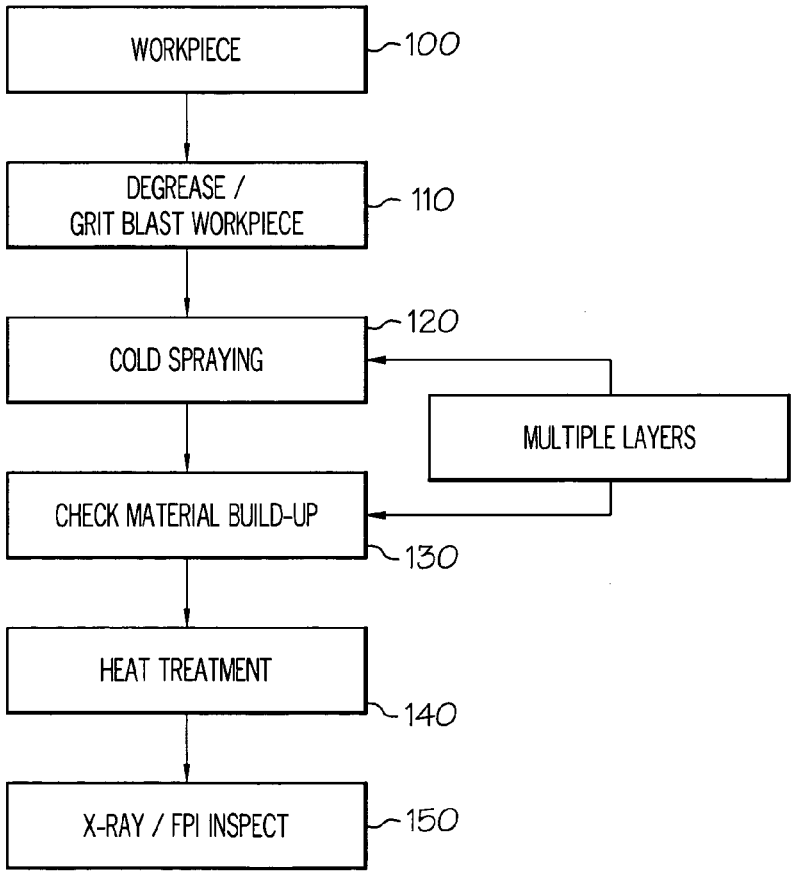
FIG. 2 is a block diagram illustrating steps in a method of making repairs according to an embodiment of the present invention.

Referring now to FIG. 2, there is shown a functional block diagram of the steps in one embodiment of the spraying process. This method includes the cold gas dynamic spray process, and also includes additional optional processes to optimize the resulting repairs. Cold high velocity gas spray involves "solid state" processes to effect bonding and coating build-up, and does not rely on the application of external thermal energy for bonding to occur. However, thermal energy may be provided after bonding has occurred since thermal energy promotes formation of the desired microstructure and phase distribution for the repaired components. Also, additional processing may be necessary to optimize bonding within the material and many thermo-mechanical properties for the material such as the elastic/plastic properties, mechanical properties, thermal conductivity and thermal expansion properties. In the method additional optional processing includes hot isostatic pressing and additional thermal treatments to consolidate and homogenize the applied material and to restore metallurgical integrity to the repaired component. The temperatures of the operations should be carefully controlled so as to maintain the desired microstructures.

A suitable workpiece is first identified in step 100. Inspection of the workpiece confirms that the workpiece is a suitable candidate. The workpiece should not suffer from mechanical defects or other damage that would disqualify it from service, after receiving the coating treatment.

Step 110 reflects that the workpiece may be subjected to a pre-processing treatment to prepare the piece for receiving a material deposition in further steps. In one embodiment a surface of the component/workpiece receives a pre-treatment machining and degreasing in order to remove materials that interfere with cold spraying such as corrosion, impurity buildups, and contamination on the face of the workpiece. In addition the piece may receive a grit blasting with an abrasive such as aluminum oxide. In a further embodiment the method includes the step of shot or grit blasting the surface of the substrate prior to coating to create a rough surface.

After these preparatory steps, deposition of coating material commences in step 120 through cold gas spraying. In one preferred embodiment, the high velocity spraying is controlled so that the maximum average temperature of the workpiece/substrate is less than 0.4 times the deposited alloy's melting temperature (0.4 Tm ° C.). In another embodiment, particles are accelerated so that they remain below their recrystallization temperature and well below their melting temperature. The spraying step can include the application of coating material to a variety of different components in a gas turbine engine. For example, material can be applied to surfaces on compressor blades, turbine blades, impellers, and vanes in general, and to airfoil surfaces such as tips, knife seals, leading/trailing edges, and platforms.

The deposition of a coating layer through cold gas spraying may occur over several deposition cycles. A first pass takes place 120. After a first pass, the coating thickness of the first layer is checked, step 130. If the build-up of material is below that desired, a second pass occurs, a repeat of step 120, on top of the first layer. The thickness of material deposited is then checked again, step 130. In this manner a series of material deposition steps are repeated, if necessary, through repetitions of steps 120 and 130. Thus a series of spraying passes can build up a desired thickness of newly deposited material. Likewise, a series of spraying passes may be required in order to cover a desired surface area with subsequent spraying passes depositing material adjacent to coatings from earlier spraying passes.

The thickness of a first deposited layer may be measured, and additional layers of material may be deposited on top of a previously deposited layer, with these steps repeated so as to generate a freestanding structure to a desired thickness. In one embodiment, the additional layers deposited over a first layer may be of a different alloy than the first, so that layers or areas of a different composition are formed giving the part improved wear resistance at some locations and a high toughness at others, depending on the loads and service the different locations experience in service. Thus, separate regions may have different compositions. Alternatively, different laminates or layers of material may have different compositions.

The next step 140 comprises performing an optional heat treatment on the coated component. The heat treatment, when performed above recrystallization temperature, can provide a degree of crystal growth, if desired. At this point in the process, a layer of material has been deposited that is at least partially amorphous in microstructure. The heat treatment, depending on the temperature and time involved, can alter the amorphous microstructure and begin the process of crystallization. This may result in very fine grains and precipitate, typically these are on a nano scale, and are difficult to attain by other means. Heat treatment may be performed up to approximately 2000° F.

Finally, an FPI (Fluorescent Penetration Inspection) inspection of a component such as a turbine blade, as well as an x-ray inspection, step 150, may follow. At this time the component may be returned to service, or placed in service for the first time.

The steps of FIG. 2 can be used, for example, to deposit a coating on a substrate surface. Exemplary substrate surfaces include turbine blades and nozzles used in gas turbine engines. Similarly the method may be used in other gas turbine engine components.

The steps of the process in FIG. 2 can also be modified for an application in fabricating an original, freestanding structure. In this method, step 100 (identifying a workpiece) and step 110 (preparing the workpiece) are eliminated. Instead, a series of cold spray depositions takes place, beginning at step 120. As will be understood in the art, the cold spray depositions can be directed such that the spray material is received on a surface or mold that acts to receive the material. The cold spray deposition is received on a surface such that additional layers of material can be built on top of the original spray layer. A series of repetitions wherein layers of cold spray material are deposited on earlier layers of material then takes place. Sprayings take place until a desired thickness or form is built up. Once a desired depth of material is created, the deposited layers may be removed so as to generate a freestanding structure. In this way a freestanding structure, rather than a coating, can be created. As will be understood in the art, spraying depositions can be interspersed with optional heat treatments if desired.

In performing depositions with nickel-based alloys, it is generally preferred to perform spraying at relatively high velocities. The higher velocities are required to obtain a good coating because of the high strength of the nickel alloys. The higher velocities can be more easily achieved by the use of an He gas. Additionally, the use of a fine powder facilitates acceleration of the alloy powder to higher velocities. A spherical or "chunky" particle of less than 50 microns is preferred, and a micron size of less than 20 is still more preferred.

After a nickel-based coating has been deposited (or a desired structure built up) it may be used as is, or subjected to a heat treatment. A piece may be used as is, without a heat treatment and thereby retaining the amorphous microstructure of the particles, when corrosion resistance is desired. A heat treatment performed at relatively low temperatures may alternatively be used to impart a microcrystalline microstructure. For example a nickel based alloy heat treatment at 1500° F. was found to impart a very fine precipitate. Nickel-based materials may optionally be heat treated at a temperature of between about 1350° F. to about 1550° F. In addition alloys subjected to that heat treatment demonstrated an increase in hardness from approximately 850 Hv to approximately 1500 Hv. The heat treatment devitrified the amorphous structure and resulted in an extremely fine nano-microstructure. The use of a nickel-based spray coating on an amorphous starting structure also results in a structure with strength advantages.

The aluminum-based alloys have lower strength, as compared to the nickel alloys. Thus good sprayed layers may be achieved through lower impact velocities. For safety purposes, nitrogen is preferred to air as the carrier gas. Additionally, with aluminum alloys, it is preferred to use a larger particle size where possible, preferably 30 microns or greater.

Typically, the as-cast microstructure of the aluminum powders is amorphous or microcrystalline. Often powders contain a combination of both. After consolidation of AlFe type alloys and heat treatment at 600 to 700° F., there results a fine spherical precipitate. The precipitate has a thickness of approximately 50 to 200 nanometers. This microstructure displays excellent high temperature strength and stability. A thick deposit to form a duplex alloy structure allows existing Al cast structures such as e.g. valve bodies and forged aircraft wheels to have an appreciably improved high temperature strength plus erosion and corrosion resistance. Optionally aluminum alloys may be heat treated at a temperature of between about 500° F. to about 700° F.

Aluminum/Silicon alloys are useful for wear and erosion resistance. The Al30% Si alloy typically has a microcrystalline as cast microstructure. When deposited, it is useful for applications that require good performance with respect to both wear and erosion characteristics. Pistons, for example pistons used in internal combustion engines for automotive applications, are one such application. Typically they are made of a 12% Si alloy. The process described allows the Si content to be significantly increased to 30%, while refining the microstructure, improving wear, corrosion and high temperature strength. Conventional processing with such a high Si content would result in a coarse brittle structure that is unusable.

The present invention thus provides an improved method for coating turbine engine components. The method utilizes a cold high velocity gas spray technique to coat turbine blades, compressor blades, impellers, blisks, and other turbine engine components. These methods can be used to coat a variety of surfaces thereon, thus improving the overall durability, reliability and performance of the turbine engine itself.

The method can also be used to produce high toughness and hardness dies and tools for metal working or other machining and forming operations. High hardness and toughness amorphous or microcrystaline high velocity penetrators are also producible by the method, as are amorphous iron or nickel based structures with interesting magnetic properties.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A method of forming an article on a substrate surface comprising the steps of:

providing a powder of a material that comprises an alloy having an amorphous microstructure and has a particle size of between about 1 to about 50 microns;

accelerating the powder of the material in a carrier gas by a cold gas spraying process to a particle velocity of at least 300 m/s to form a deposited layer of the powder material on the substrate surface; and heat treating the deposited layer to devitrify the amorphous microstructure to form a microcrystalline nano-microstructure coating.

2. The method according to claim 1, wherein the powder alloy material has a particle size diameter of at least 5 microns; and the step of accelerating comprises controlling the cold gas spraying process so that the substrate surface has an average temperature that is less than 0.4 times the alloy's melting temperature in ° C.

3. The method according to claim 2 wherein the powder alloy material is selected from the group consisting of an alloy of aluminum, an alloy of aluminum and silicon, an alloy of aluminum and iron, an AlFeVSi alloy, an alloy of nickel, an alloy of iron, and an alloy of tungsten.

4. The method according to claim 2 wherein the powder alloy material comprises an aluminum/silicon alloy having at least 20% silicon by weight.

5. The method according to claim 1 wherein the step of heat treating comprises heating a Ni-based alloy at a temperature of approximately 1350 to approximately 1550° F.

6. The method according to claim 1 further comprising the step of heating an aluminum-based alloy at a temperature of approximately 500° F. to approximately 700° F.

7. The method according to claim 1 wherein the carrier gas in the step of accelerating the powder in a carrier gas comprises an inert gas.

8. The method according to claim 1 further comprising depositing a layer of material on top of a previously deposited layer of material.

9. The method according to claim 8 wherein the step of depositing a layer of material on top of a previously deposited layer of material is repeated until a desired depth is created, and further comprising removing the deposited layers from the surface so as to generate a freestanding structure.

10. The method according to claim 8 wherein the layer of material deposited over a previously deposited layer has a different composition than the previously deposited layer.

11. A method of forming an article on a substrate surface comprising the steps of:

providing a powder of a material that comprises an alloy having an amorphous microstructure and has a particle size of between about 1 to about 50 microns;

accelerating the powder of the material in a carrier gas by a cold gas spraying process to a particle velocity of at least 300 m/s to form a deposited layer of the powder material on the substrate surface; and heat treating the deposited layer to devitrify the amorphous microstructure to form a coating consisting of a microcrystalline nano-microstructure.

12. The method according to claim 11 wherein the step of heat treating comprises heating a Ni-based alloy at a temperature of approximately 1350° F. to approximately 1550° F.

13. The method according to claim 11 further comprising depositing a layer of material on top of a previously deposited layer of material.

14. The method according to claim 13 wherein the step of depositing a layer of material on top of a previously deposited layer of material is repeated until a desired depth is created, and further comprising removing the deposited layers from the surface so as to generate a freestanding structure.

15. The method according to claim 13 wherein the layer of material deposited over a previously deposited layer has a different composition than the previously deposited layer.

16. The method according to claim 11 wherein the powder alloy material comprises an alloy of nickel.

17. The method according to claim 11 wherein the powder alloy material comprises an aluminum/silicon alloy having at least 20% silicon by weight.

* * * * *